US006159338A

United States Patent [19]

Qvintus et al.

[11] Patent Number: 6,159,338

[45] Date of Patent: Dec. 12, 2000

[54] SUPPLY OF WASHING LIQUID IN A FRACTIONATING MULTI-STAGE WASHER

[75] Inventors: Harri Qvintus, Glens Falls, N.Y.; Pekka Tervola, Helsinki, Finland

[73] Assignee: Andritz-Ahlstrom Oy, Espoo, Finland

[21] Appl. No.: 09/029,640

[22] PCT Filed: May 31, 1996

[86] PCT No.: PCT/FI96/00316

§ 371 Date: Mar. 23, 1998

§ 102(e) Date: Mar. 23, 1998

[87] PCT Pub. No.: WO97/10379

PCT Pub. Date: Mar. 20, 1997

[30] Foreign Application Priority Data

Sep. 11, 1995 [FI] Finland ..... 954259

[51] Int. Cl.[7] ..... D21C 5/00; D21C 9/02

[52] U.S. Cl. ..... 162/56; 162/60

[58] Field of Search ..... 162/60, 56

[56] References Cited

U.S. PATENT DOCUMENTS 3,454,970 7/1969 Sutherland .

4,705,600 11/1987 Jacobsen ..... 162/19

5,116,423 5/1992 Kokkonen et al. ..... 134/15

5,741,399 4/1998 Antkowiak ..... 162/43

*Primary Examiner*—Christopher A. Fiorilla

*Attorney, Agent, or Firm*—Nixon & Vanderhye P.C.

[57] ABSTRACT

A method of displacement washing of cellulose pulp achieves substantially optimal results without the consumption of excessive clean wash liquid. In the practice of the method there is at least one washing stage, and a second stage, including a suction, press, and/or thickening stage, following the washing stage. Cellulose pulp is fed to the washing stage, and then the washed pulp is fed to the second stage. A first filtrate is withdrawn from the second stage and a second filtrate is withdrawn from a washing stage of the at least one washing stage, or the second stage. The first filtrate is directed to the washing stage and the first filtrate is used as washing liquid in the washing stage. For example the washing stage may include a last washing stage in a multi-stage fractionating washer, and the second stage may be in the fractionating washer; and the first filtrate may be directed to the last washing stage of the multi-stage fractionating washer.

19 Claims, 9 Drawing Sheets

SUPPLY OF WASHING LIQUID IN A FRACTIONATING MULTI-STAGE WASHER

CROSS-REFERENCE TO RELATED APPLICATION

This application is a U.S. national phase of application PCT/FI96/00316, international filing date May 31, 1996.

BACKGROUND AND SUMMARY OF THE INVENTION

The present invention relates to a method of and apparatus for intensifying the washing of pulp with various washing apparatus. The method and apparatus are particularly well applicable in connection with the so-called Drum Displacer washers, DD washers, by A. AHLSTROM CORPORATION, and also in some wash presses. Because the method and apparatus of the invention are applicable in connection with other washing devices also, different apparatus used in washing are discussed here.

Several types of different washing apparatus and methods are know from the prior art. Diffusers, drum washers and belt washers clearly differ from each other. Pulp is supplied into washing diffusers at a consistency of approx. 10%. The feeding consistency for drum and belt washers is most usually 1–3%. Suction washers, wash presses and pressurized or super-atmospheric washers are examples of drum washers used today.

A conventional suction washer comprises a wire-covered drum revolving in a vat. The shell of the drum comprises under a perforated plate collecting compartments, and each compartment is connected with a tube of its own to a valve system on the shaft at the end of the drum. Filtrate from the valve is guided via a drop leg, or a centrifugal pump providing the required suction, for example to a filtrate tank. Due to the valve arrangement, the influence of the drop leg may be directed appropriately in the desired spots of the web formation.

Web formation in a suction washer takes place as follows: inside the drum revolving in the vat, sub-atmospheric pressure sucking pulp suspension from the vat onto the surface of the drum has been arranged by means of a drop leg or some other device generating suction. When the liquid passes through the drum the fibers in the pulp are collected onto the surface of the drum. The consistency of the suspension in the drum in approx. 0.5–2% and the consistency of the layer thickened onto the drum surface is approx. 10–12%. The web formation area, i.e. the portion of the drum periphery which is in the vat in the fiber suspension, is about 140 degrees. The maximum revolution velocity of the drum is 2–2.5 r/min; at higher revolutions speeds the filtrate collecting compartments and tubes do not have time to be emptied.

Washing is carried out as displacement wash by spraying wash liquid onto the surface of the drum which has risen up from the pulp vat. The sub-atmospheric pressure sucks the wash liquid through the pulp layer and displaces most of the liquid in the pulp. Thus, the displacement area is about 120 degrees. The typical specific square load of a suction washer is approx. 5 BDMT/m$^2$/d and the thickness of the pulp web is of the order of 25 mm. In a bleaching plant, the square load of a suction washer is about 8 BDMT/m$^2$/d and the web thickness about 30 mm.

A wash press comprises a drum covered with a wire or having a drilled perforated plate shell. Pulp is fed at a consistency of 3–4% and knots and corresponding impurities must have been removed from the pulp prior to the washer. There are compartments provided in the shell of the drum from which filtrate is discharged via a chamber at an end periphery. Also, the drum may be open so that filtrate is collected inside the drum and is discharged via an opening at an end.

The length of the web formation stage is about 90 degrees and that of the displacement stage about 150 degrees. The revolution velocity of the drum is about 2 r/min and the specific square load about 15–20 BDMT/m$^2$/d. The consistency of the washed web may rise even up to 35%.

The displacement, however, takes place at a consistency of about 10–15% while the thickness of the pulp web is about 30–50 mm.

An example of a superatmospheric pressure washer is a device disclosed in FI patent publications 71961 and 74752, which is composed mainly of a rotating drum and a stationary shell surrounding the drum. The drum is comprises a perforated cylinder the outer surface of which is provided with 50–60 mm high ribs at about 200 mm spacing. These ribs form with the perforated cylinder surface the so-called pulp compartments. There are filtrate compartments provided inside the cylinder under the pulp compartments, into which the filtrate displaced by the wash liquid is collected. There is a valve arrangement at the end of the cylinder drum substantially at the periphery of the diameter via which valve arrangement the filtrate is discharged and transported further. The washer comprises several, usually 3–4 stages. This means that the wash liquid is reused many times for washing the pulp; thus, the filtrate collected in the filtrate compartments is guided countercurrent from one washing stage to another. Outside the washer drum, as a part of the washer shell, there are wash liquid feed chambers from which the wash liquid is pressed through the perforated plate to the pulp in the pulp compartments to displace the liquid in the pulp.

Web formation and washing of the pulp is carried out by supplying the pulp to be washed via a particular feed box to the pulp compartments. The feed box may thicken the pulp and axial "bars" of the same length as the drum are formed in the pulp compartments. Immediately after the feed point, there is the first washing zone on the drum; there are five separate washing zones in the apparatus described in the publications mentioned. A wash liquid flow is guided to each of these zones and the wash liquid, while being pressed into the pulp layer in the compartments of the washing drum, displaces the liquid in the pulp. As already mentioned above, the filtrates are guided countercurrent from one zone to another. In other words, (cf. FI patent 74752, FIG. 1) clean wash liquid is pumped into the last washing stage and the filtrate displaced by this liquid is taken to the second last washing stage to serve as wash liquid. After the last washing stage, the "pulp bars" are detached from the drum, for example by blowing with pressurized air, and transported further on a transport screw.

The typical specific square load of a pressurized washer of this type with four stages is approx. 2.4 BDMT/m$^2$/d. The thickness of the "pulp bar" is about 50 mm and the consistency may rise even up to 15–18%. However, wash water leaking from the compartment decreases the consistency to 10–12%. The consistency of the pulp fed onto the drum may vary between 3,5 and 10%. The drum is rotated at about 0.5–3.0 rpm.

The FI patent 74752 mentioned above (corresponding U.S. Pat. Nos. 4,919,158 and 5,116,423) and the appended FIG. 2 illustrate schematically a little more advanced version of the basic approach of FI patent 71961, by means of which a remarkably better washing result is obtainable than with the basic arrangement illustrated schematically in the appended FIG. 1. In the embodiment of FIG. 2, each washing stage has been divided into two zones so that two washing filtrates with different concentrations are obtained from each stage. These filtrates are recycled countercurrent as illustrated in the Figure. The figure illustrates also how the so-called suction filtrate, i.e. the filtrate extracted from the point between the last washing stage and the pulp discharge, is taken, with the washing filtrate from the latter washing zone of the last washing stage, to the latter washing zone of the second last washing stage to be used as wash liquid.

It is typical of all the above apparatus that at least either the feed of the wash liquid or the treatment of the filtrates or both at the same time show drawbacks. These drawbacks may result in among other things poor washing result. If a washer is found not to be able to reach an adequate washing result the consequence naturally is that a washer with more washing stages or even a washer of a different type is acquired. It may also be necessary to try to solve the problem by increasing the consumption of clean wash liquid which increases the demand of steam in the evaporation plant and the capacity of waste water treatment equipment has to be increased and partly also environmental load increases.

The object of the invention is to solve the problems described above and to introduce arrangements applicable in many different washer types by means of which washing results are achieved which are very close to the optimal washing results obtainable with each washer or process type.

The characteristic features of the method and the apparatus are disclosed in the appended patent claims.

BRIEF DESCRIPTION OF THE DRAWINGS

The method and the apparatus according to the invention is described below in detail by way of example with reference to the accompanying drawings of which

DETAILED DESCRIPTION OF THE INVENTION

Figure 1:
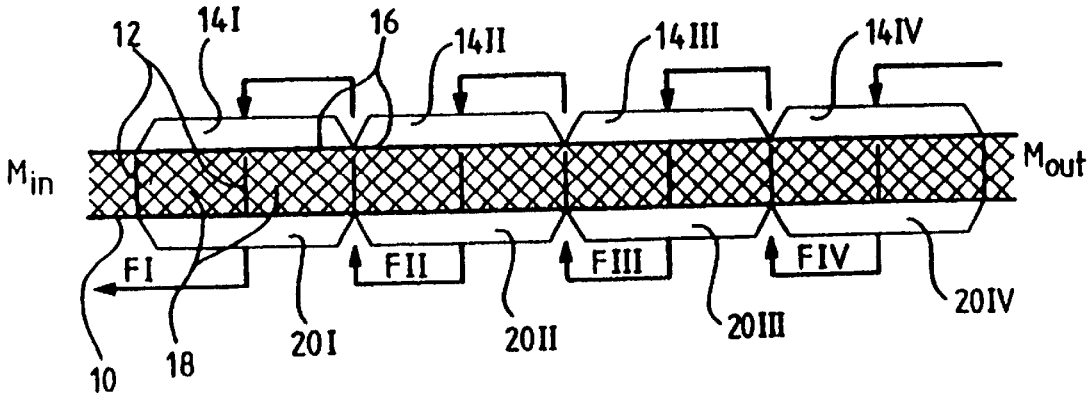
FIG. 1 (Prior Art)
FIG. 1 illustrates schematically the operation principle of a prior art multi-stage washer.

The operation principle illustrated schematically in FIG. 1 has been applied for example in the so-called DD washer according to FI patent 71961 by A. AHLSTROM CORPORATION. FIG. 1 illustrates how pulp Min is supplied onto the perforated and moving wire 10 of the apparatus. The wire may be cylindrical, a wash drum, or for example a plane-like surface, a belt washer. The wire 10 has been provided with baffles 12. opposite the wire surface 10, there are stationary wash water feed chambers 14 the bottoms 16 of which, together with the baffles 12 and the wire surface 10, form pulp washing compartments 18. Under the wire surface 10, there are a number of filtrate compartments 20 for collecting the filtrate displaced from the pulp by the wash water. The patent mentioned also describes more closely how the filtrate is transported further from the filtrate compartments 20 via a valve device provided at the end of the drum. The Figure shows that there are four washing stages I–IV in the apparatus. There are also corresponding wash liquid feed chambers $\mathbf{14}_{I}$, $\mathbf{14}_{II}$, $\mathbf{14}_{III}$ and $\mathbf{14}_{IV}$, and filtrate compartments $\mathbf{20}_{I}$, $\mathbf{20}_{II}$, $\mathbf{20}_{III}$ and $\mathbf{20}_{IV}$. It is typical of the operation of the apparatus that clean wash liquid $W_I$ is brought to the fourth washing stage IV, in which the pulp is cleanest. Filtrate $F_{IV}$ from the fourth washing stage is brought to the third washing stage III to serve as wash liquid, and so on, until the filtrate $F_I$ from the first washing stage is directed to waste water treatment, for example to an evaporation plant, and/or it is used as for dilution in a blow tower. As may be understood from the above, the apparatus is capable of replacing four conventional one-stage washers.

Figure 2:
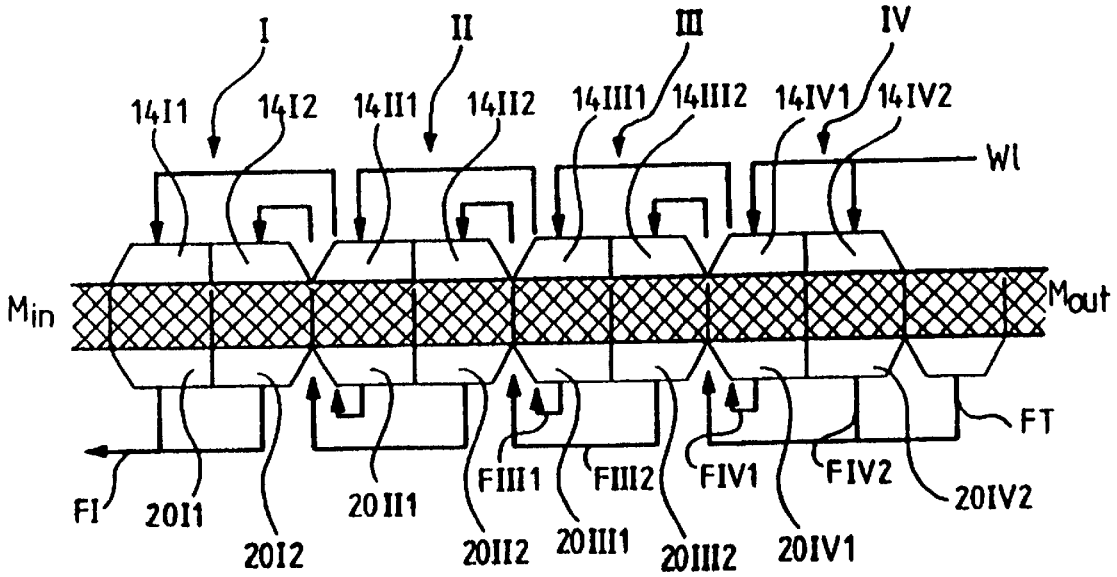
FIG. 2 (Prior Art)
FIG. 2 illustrates schematically the operation principle of another prior art multi-stage washer.

FIG. 2 illustrates schematically a more advanced version of the same washer. This washer has been described more closely for example in U.S. Pat. Nos. 4,919,158 and 5,116,423. As the Figure shows, the washer still comprises four washing stages I–IV but each washing stage has been divided internally into two washing zones and filtrates of different concentrations are extracted from these zones. Thus, clean wash liquid $W_I$ is brought to the fourth washing stage IV to displace filtrate from the pulp. Because of the fact that in the displacement washing of the type described the concentration of the liquid in the pulp decreases at a relatively even rate from the pulp feed $M_{in}$ to the pulp discharge $M_{out}$, the filtrate compartment $\mathbf{20}_{IV}$ of the fourth stage has been divided into two portions $\mathbf{20}_{IV1}$ and $\mathbf{20}_{IV2}$, which thus collect filtrates $F_{IV1}$ and $F_{IV2}$ of different concentrations. Now these filtrates $F_{IV1}$ and $F_{IV2}$ are guided countercurrent, i.e. to the third washing stage III so that the cleanest filtrate, i.e. the filtrate $F_{IV2}$, from the latter zone of the fourth stage is guided to the feed chamber $\mathbf{14}_{III2}$ of the latter zone of the third stage III to serve as wash liquid. Correspondingly, the more fouled filtrate, i.e. the filtrate $F_{IV1}$ from the former zone of the fourth stage, is directed to the feed chamber $\mathbf{14}_{III1}$ of the former zone of the stage III to be used as wash liquid. Continuing the process by this method to the end of the wash, pulp may be produced which is about 15–30% cleaner than the one produced by the arrangement of FIG. 1.

Generally, it may be stated that the operation principle of a so-called fractionating multi-stage washer of this kind is to receive several filtrates from a washing stage or several washing stages and then to feed the filtrates to a previous washing stage to the zone having the same ordinal number, to be used as wash liquid. Thus, although a washer, in which each stage has been divided into two zones, has been described nothing prevents the stages from being divided into, for example, three zones whereby three different filtrates are received. Of course, it is also possible to divide separate stages into zones in a different way. In other words, for example only one filtrate may be extracted from a washing stage into which two or more wash liquids of different concentrations are supplied. In the so-called DD washer, the first washing stage is often of this kind; thus in some cases the filtrate from the first washing stage is extracted as one fraction to be transported for dilution of pulp and/or chemical recovery.

FIG. 2 also illustrates how, as described in the patents mentioned, the so-called suction filtrate $F_T$ obtained from between the last washing stage IV and the pulp discharge $M_{OUT}$ is guided, with the cleaner filtrate $F_{IV2}$ obtained from the fourth stage IV, to the feed chamber $\mathbf{14}_{III2}$ to be used as the wash liquid in the latter zone of the third stage III.

Further, according to the patents mentioned, the filtrates from the first washing stage I are combined, $F_I$, and are guided for example to an evaporation plant or to some other filtrate treatment. The US patents mentioned describe further that yet another filtrate may be obtained when feeding in pulp $M_{in}$; this filtrate is discharged from the apparatus separately from the washing stage filtrate $F_I$.

When looking at the process closer, however, the filtrate treatment arrangement of FI patent 74752 or U.S. Pat. Nos. 4,919,158 and 5,116,423 may be made more efficient. Between the last washing stage, which in this embodiment is the fourth washing stage IV, and the pulp discharge point $M_{out}$, so-called suction filtrate $F_T$ is separated from the pulp which is used as wash liquid and referred to in the patents mentioned with reference number 27. The suction filtrate $F_T$ comes mainly from the last filtrate compartment and possibly from the thickened pulp. Thus, the composition of the suction filtrate $F_T$ resembles most the wash liquid $W_1$ supplied to the washer.

Firstly, it should be noted that, if there is a suction filtrate flow $F_T$ of the kind described, there is less wash liquid flowing into the last washing stage than to the remaining washing stages. Secondly, the suction filtrate $F_T$ is cleaner than the pulp leaving the second last washing stage but only a little dirtier than the pulp discharged from the washing process, i.e. the washer.

Thus, in the arrangements of the patents mentioned, the fairly clean suction filtrate $F_T$ is taken unnecessarily far upstream.

Figure 3:
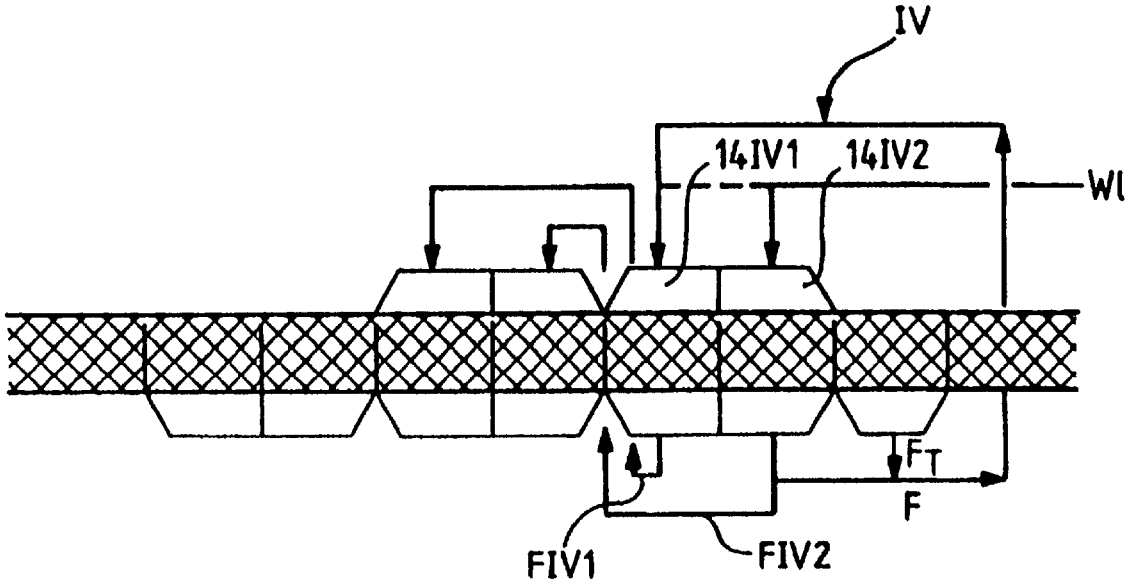
FIG. 3 illustrates a preferred embodiment of the invention.

As illustrated in FIG. 3, the washing process may be made more efficient by supplying the suction filtrate $F_T$ to the feed chamber $\mathbf{14}_{IV1}$ of the first zone of the last washing stage IV, and not to last zone of the second last washing stage III as described in the FI and US patents. The Figure illustrates how a portions of the filtrate $F_{IV2}$ from the last zone of the last washing stage IV is extracted and combined with the suction filtrate $F_T$ from the thickening stage and the mixture is supplied to the first zone of the last washing stage IV. The Figure also indicates with a broken line that clean wash water $W_1$ may be supplied, not only to the feeding chamber $\mathbf{14}_{IV1}$ of the last zone of the last washing stage IV, but also to form a part of the wash liquid supplied to the feed chamber $\mathbf{14}_{IV1}$ of the first zone of the last washing stage IV. By arranging the circulation of the suction filtrate $F_T$ in. the way described above the volume of the wash liquid fed into the last washing stage IV and the suction filtrate $F_T$ is used for one extra wash.

Figure 4:
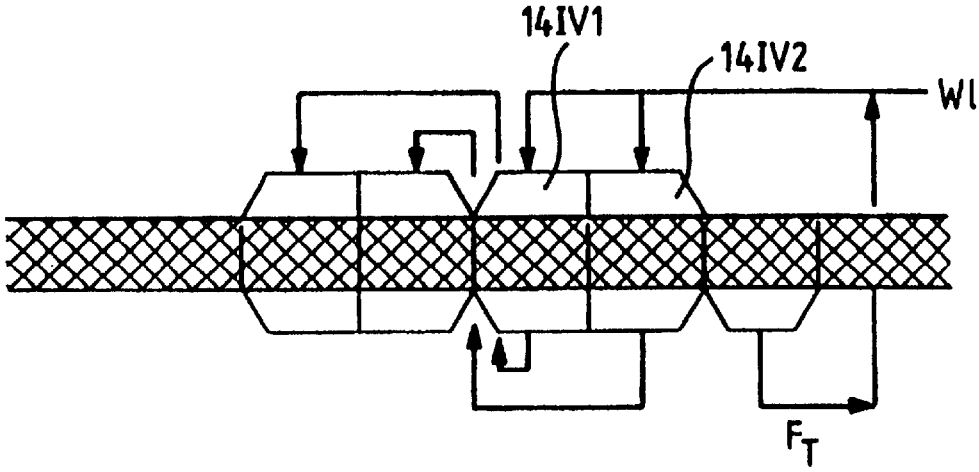
FIG. 4 illustrates another preferred embodiment of the invention.

Another way of circulating the suction filtrate $F_T$ is to feed it, combined with clean wash liquid $W_1$, to both the feed chambers, $\mathbf{14}_{IV1}$ and $\mathbf{14}_{IV2}$, of the last washing stage IV as illustrated in FIG. 4.

It may also be understood that there is a further washing stage subsequent to the last washing stage IV and the suction filtrate $F_T$ comes from this extra washing stage.

Performed tests have shown that the new way of circulating of the suction filtrate according to the invention increases the purity of the pulp by 5–35% depending on the number of washing stages performed with the washer. Naturally, the purity increase is the greater the fewer washing stages there are in the washer. In a conventional two-stage washer the washing result improves by about 15–35%.

Figure 5:
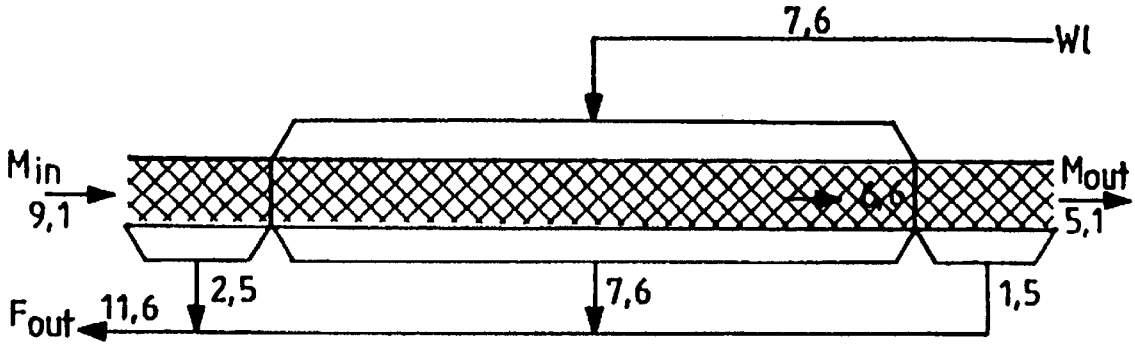
FIG. 5 (Prior Art)
FIG. 5 illustrates a conventional way of treating suction filtrate.
Figure 6:
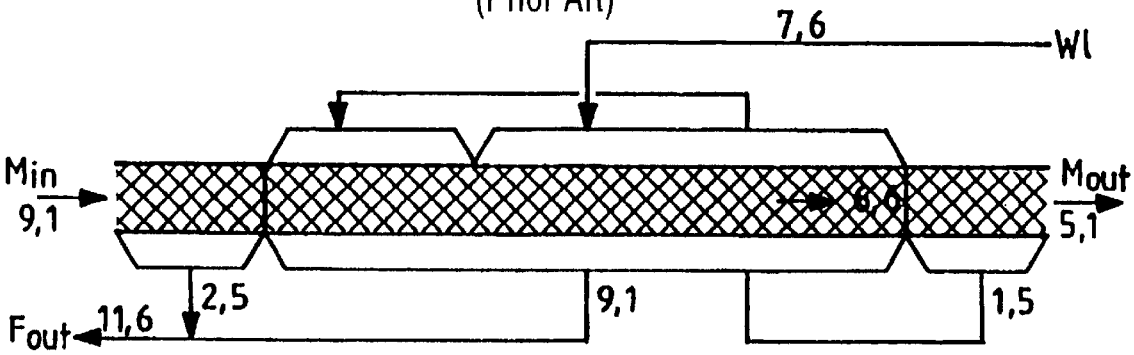
FIG. 6 illustrates a way according to a preferred embodiment of the invention, of using suction filtrate.

FIGS. 5 and 6 illustrate the effect of recirculating the suction filtrate in the liquid circulation of a one-stage washer. The numerals in the Figures represent the liquid flows, expressed in cubic meters, used for washing one ton of pulp (ADT; consistency 90%, i.e. one ton of pulp contains 900 kg fibers and 100 kg liquid). Thus, pulp containing 9.1 cubic meters of liquid per one ton of pulp, consistency about 9%, is introduced to the washing; during the web formation 2.5 tons of liquid is removed and the consistency in the washing process is about 13.5%. From this, 1.5 cubic meters of suction filtrate is still removed in the suction stage and thus the discharge consistency of the pulp is about 17.6%. FIG. 5 illustrates a state-of-the-art one-stage washer in which the suction filtrate is combined with the filtrate from the web formation and the washing stage proper and is removed from the apparatus for further treatment of filtrates or for some other use.

FIG. 6 illustrates a case in which the suction filtrate is directed to the beginning of the washing stage; thus, 1.5 cubic meters more of wash liquid per ton of pulp is supplied to the wash itself. As with these amounts the volume of wash liquid is relatively directly proportional to the washing result, it may be stated that in this kind of a case the washing result improves by about 20%.

Figure 7:
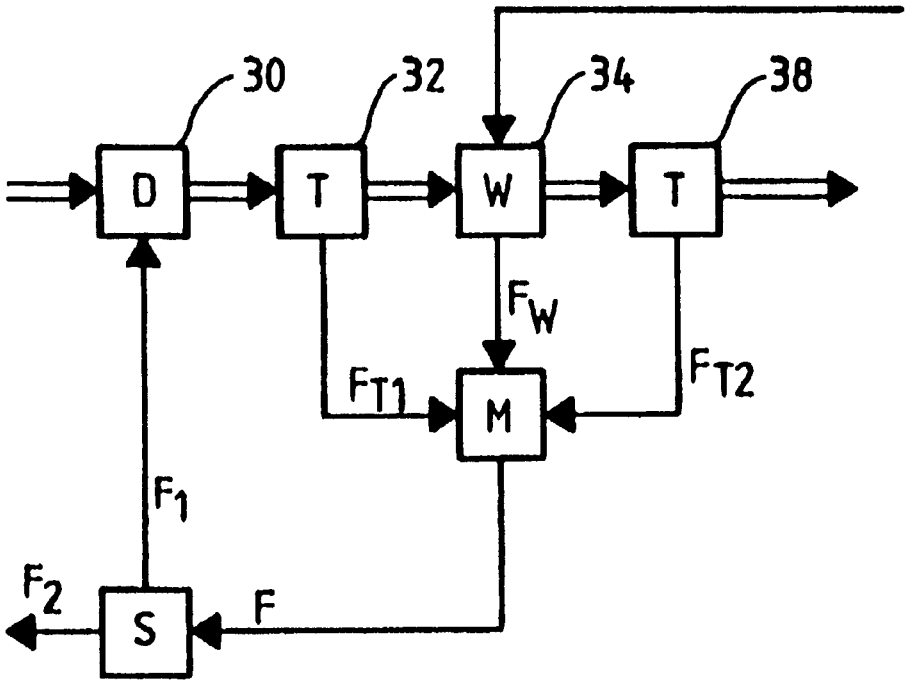
FIG. 7 (Prior Art)
FIG. 7 illustrates a prior art wash press arrangement.

FIG. 7 illustrates schematically a prior art pulp washing arrangement using a wash press. According to the arrangement of the Figure, pulp is brought for example from a digester or a blow tank of a digester to dilution 30 and diluted to a consistency of approx. 4%. After the dilution the pulp is taken to a thickener 32 in which the pulp is thickened to a consistency of about 10–15% The medium consistency pulp obtained is supplied to a displacement stage 34 into which clean wash liquid is supplied. The pulp is further taken to a thickening stage 38, in which liquid is removed from the pulp so as to raise the consistency to the range of 30–40%. It is typical of the state-of-the-art wash press arrangements that the filtrates $F_W$, $F_{T1}$, and $F_{T2}$ obtained as well from the washing as from the preceding and subsequent thickening stages are combined irrespective of their different concentrations. A portion $F_1$ of the filtrate mixture F obtained in this way is used in the dilution stage 30 to dilute pulp while the other portion $F_2$ goes to chemical recovery or some other further use or treatment.

Figure 8:
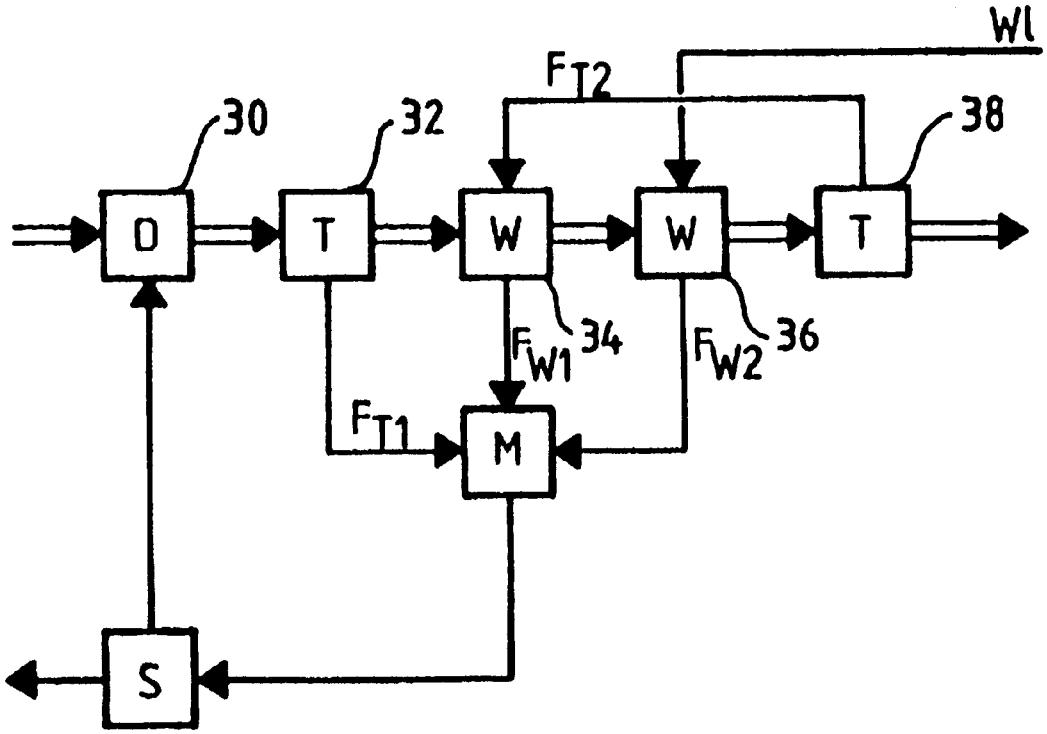
FIG. 8 illustrates a third preferred embodiment of the invention applied in a wash press arrangement.

FIG. 8 illustrates a wash press arrangement according to the invention the most significant difference of which compared to the arrangement of FIG. 5 is that the wash press includes two washing stages. The reference numerals used in FIG. 8 correspond to the ones used in FIG. 5; the second washing stage is referred to with numeral 36 and its filtrate with $F_{W2}$. When the two washing stages 34 and 36 have been connected the filtrates obtained from the system may be transported countercurrent so that the relatively clean filtrate $F_{T2}$ from the last thickening stage 38 of the system is used as wash liquid in the first washing stage 34. Clean wash liquid $W_1$ from an external source is brought only to the second washing stage 36.

Figure 9:
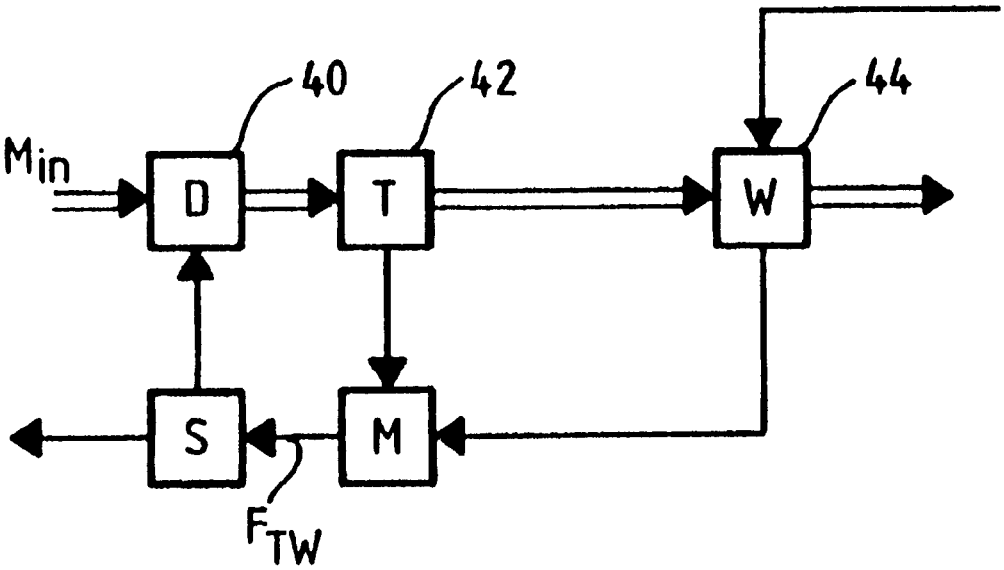
FIG.9 (Prior Art)
FIG. 9 illustrates a prior art washing model.
Figure 10:
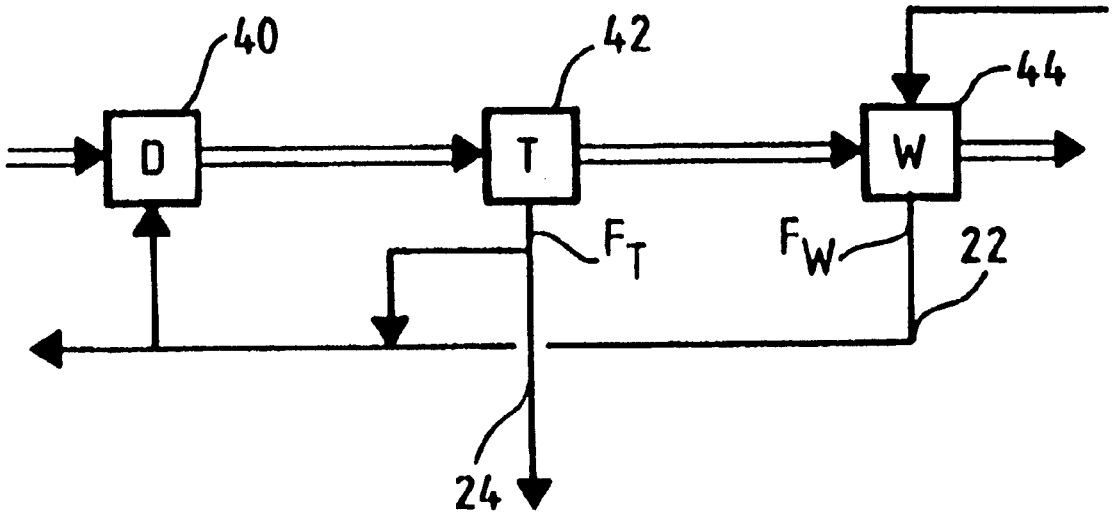
FIG. 10 illustrates a washing model according to a fourth preferred embodiment of the invention.

It should be noted here that the dilution, thickening and displacement stages mentioned both in connection with FIG. 8 as well as with FIGS. 9 and 10 may be carried out in one and the same apparatus or in separate apparatus located even quite far apart from each other. In practise, the distance between the operations is not of as decisive importance as the method of carrying out the process. In other words, FIGS. 9 and 10 may illustrate for example a prior art washer connection and an improvement made therein. Thus, as in FIG. 9, for example the pulp $M_{in}$ coming from a digester may be diluted to a low consistency for example in a blow tank 40 by using filtrate $F_{TW}$ for this purpose, which may be for example a mixture of filtrate from a thickening stage of a DD washer by A. AHLSTROM CORPORATION, forming the "pulp bar" in the washing space and from a washing stage 44. However, the concentration of the filtrate of the thickening stage mentioned is the same as the concentration of the liquid remaining in the pulp, i.e. the concentration of the liquid used for the dilution has not been paid attention to previously. FI patent 74752, and U.S. Pat. Nos. 4,919,158 and 5,116,423, however, show that the filtrates mentioned are taken separately. Further use or treatment of either of the filtrates is, however, not discussed.

FIG. 10 illustrates a preferred embodiment of the invention improving the process described above. The arrangement of FIG. 9 has been changed so that washing stage filtrate $F_W$ and a portion of the filtrate $F_T$ from the thickening stage 42 are used for the dilution 40. The rest of the filtrate from the thickening stage 42 is guided to chemical recovery. An arrangement of this kind has been found to improve the washing result by 10–15%. Of course the entire dilution may be carried out with washing stage filtrate if that suffices. In other words, previously filtrates from both the thickening and the washing stages were mixed with each other and after that a portion of this combined filtrate was used for dilution. According to the method of the present invention, only the amount of the filtrate from the thickening stage is taken to the dilution that falls short from the filtrate from the displacement stage. When carried out the way described above the concentration of the filtrate used for the dilution is lower than that of the filtrate used in the prior art arrangement.

Figure 11:
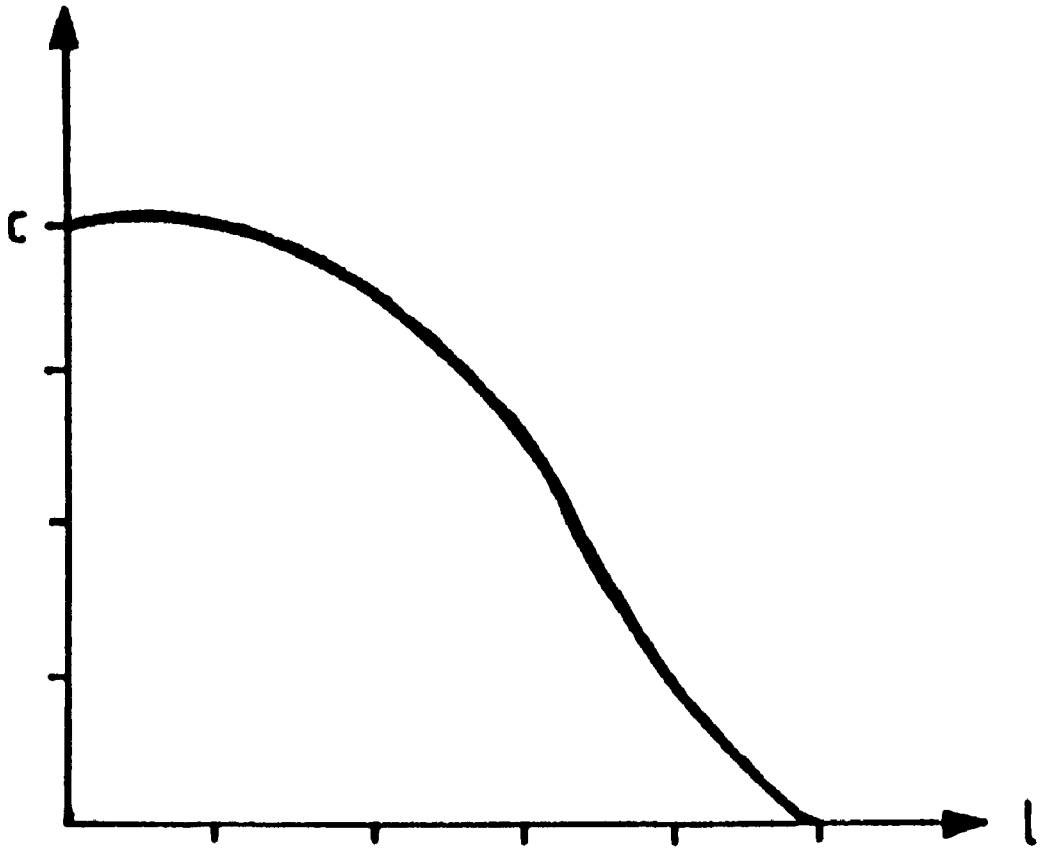
FIG. 11 illustrates distribution of concentration of the filtrate as a function of the length of the fiber mat.

The methods described above may still be made more efficient by focusing on the typical concentration distribution of the filtrate which has been illustrated schematically in FIG. 11 as a function of the mat length, i.e. the length of the washing stage. The Figure clearly indicates that the closer the end of the washing stage is the lower the concentration of the filtrate is, i.e. the cleaner the filtrate is. This means that filtrate may be taken from the end of the wash and used even at the beginning of the same washing stage.

Figure 12:
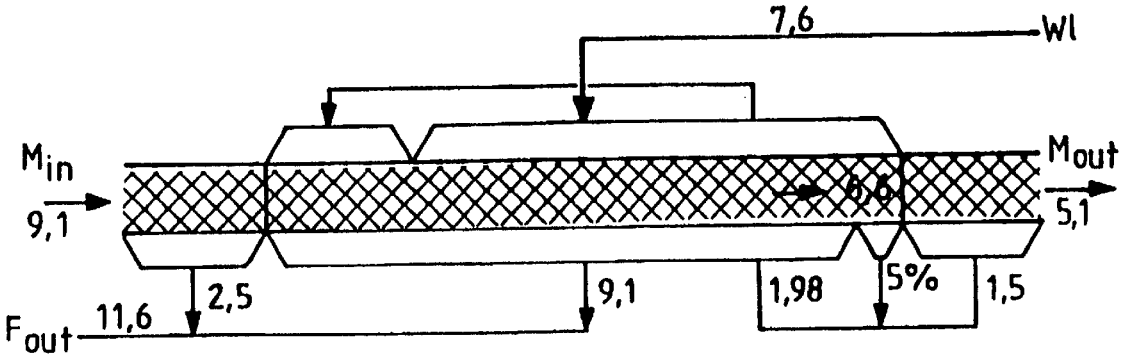
FIG. 12 illustrates a washing model according to a fifth preferred embodiment of the invention.
Figure 13:
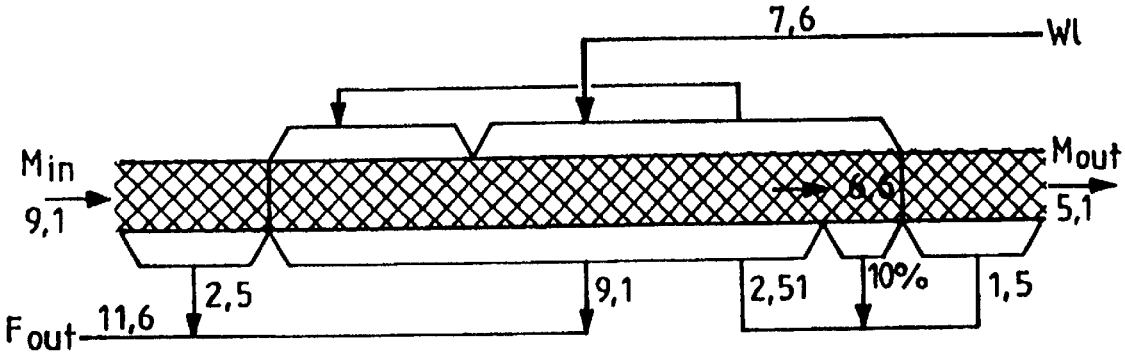
FIG. 13 illustrates a washing model according to a sixth preferred embodiment of the invention.
Figure 14:
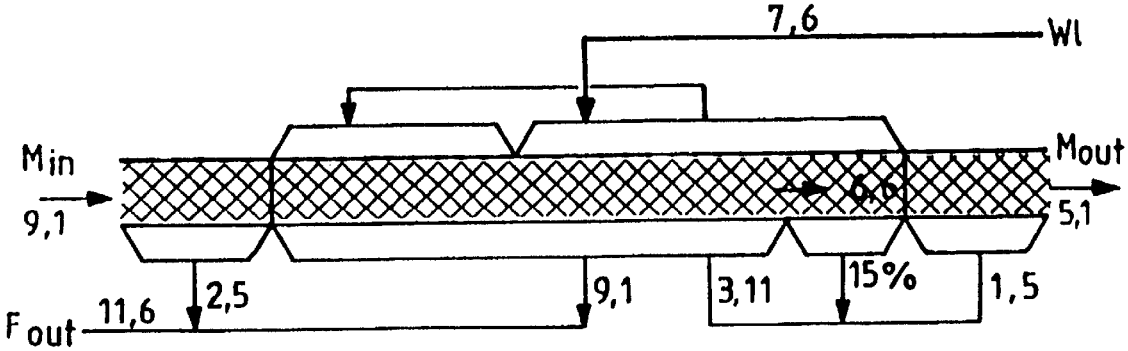
FIG. 14 illustrates a washing model according to a seventh preferred embodiment of the invention.

FIGS. 12, 13 and 14 illustrate examples in connection with a single-stage washer of how 5–15% of the displacement filtrate from the end part of a washing stage is taken to the beginning of the washing stage. In practise it is possible to bring greater volumes, i.e. a greater portion of the filtrate, to the beginning of the washing stage. Naturally, it is also possible to fractionate the filtrate to be recirculated, i.e. to extract filtrates of several different concentrations and to recirculate them at different points in the beginning of the washing stage, of course the most concentrated first.

Figure 15:
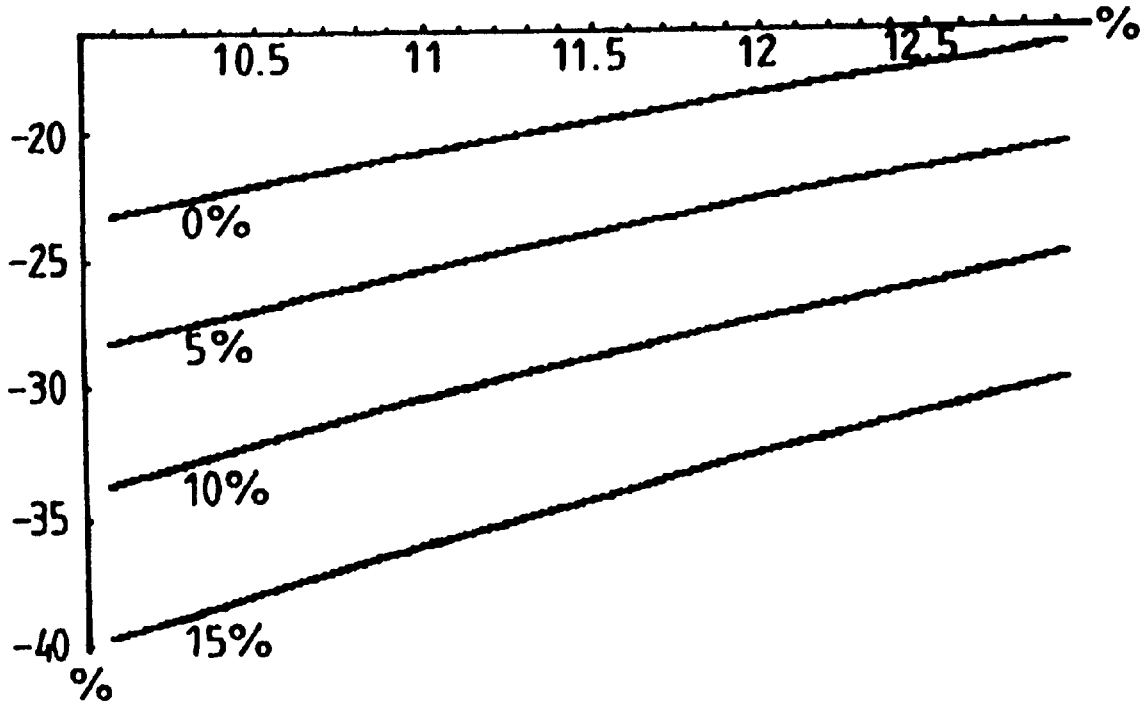
FIG. 15 illustrates the influence of the recycling of the suction filtrate and filtrate according to the invention on the purity of the pulp.

FIG. 15 illustrates comparision of the single-stage washer connections illustrated in FIGS. 5, 6, 12, 13 and 14. The horizontal scale depicts the percentage of solid material dissolved from the material, i.e. chemicals and fibers, which on principle should have been removed from the pulp but which the apparatus has not been able to remove. Thus, the scale in the Figure illustrates the range in which 10–13% of the "dirt" is still there. The vertical axis indicates the percentage of washing loss change. Washing losses here mean the amount of dissolved dry solids and chemicals remaining in the liquid in the pulp after the wash. The invention aims at diminishing these washing losses. The initial situation in FIG. 15 is the connection illustrated in FIG. 5, according to which the suction filtrate is removed from the apparatus with other filtrates and it is not returned to the apparatus; thus the descriptor is the horizontal axis of the scale (notice the real zero point of the scale). The 0% curve depicts the influence of the connection illustrated in FIG. 6, i.e. an arrangement in which the entire suction filtrate is returned to the beginning of the washing stage but the filtrate from the displacement washing stage itself is left untouched. The 5% curve depicts the influence of the connection illustrated in FIG. 12, i.e. an arrangement in which 5% of the displacement wash filtrate is recycled with the suction filtrate to the beginning of the washing stage. Correspondingly, the 10 % and the 15% curves represent the effect of the arrangements illustrated in FIGS. 13 and 14. The Figure indicates that if pulp discharged from a conventional washing stage (FIG. 5) contains 11% of the chemicals and the dissolved dry solids, this washing loss may be reduced by about 21% by recycling the suction filtrate to the beginning of the washing stage. This means that the washing loss is reduced to 8.7%. Correspondingly, if the suction filtrate mentioned and also 10% of the displacement wash filtrate is recycled to the beginning of the washing stage the washing loss is reduced by about 30.5%, i.e. the washing loss is reduced to about 7.6%. Thus the washing loss is reduced from 8,69 to 7.645, which means about 12%.

Figure 16:
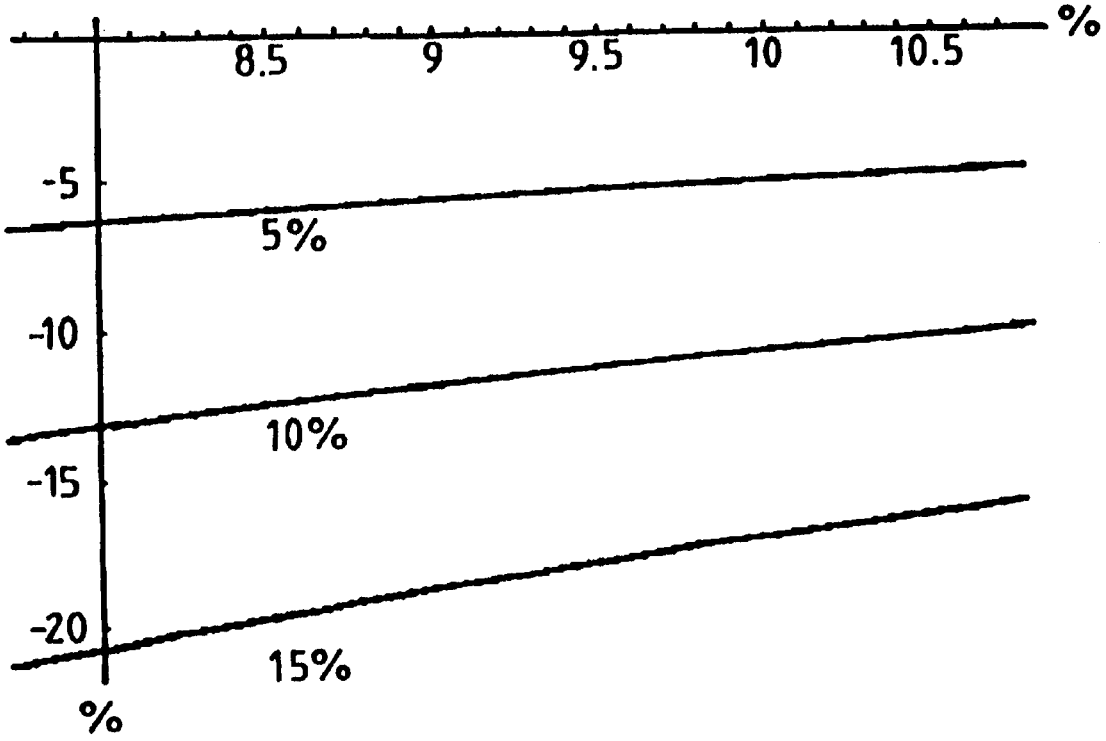
FIG. 16 illustrates the influence of the recycling of the filtrate according to the invention on the purity of the pulp.

FIG. 16 similarly shows a set of curves the initial situation of which is that the recycling of the suction filtrate has already been employed. By using this set of curves the situation with the first example of the previous Figure may be checked, in which the washing loss was 8.7% and it was further reduced to 7.8% by returning 10% of the filtrate obtained from the end of the washing stage to the beginning of the wash. By choosing 8.7% from the horizontal scale and coming down to the 10% curve, the washing loss reduction may be seen to be about 12% as already calculated above.

Recycling a part of the displacement filtrate as described above requires a filtrate compartment of its own to be provided, one way or another, at the end of the washing stage. A preferred way of effecting this is to use a movable sealing member to separate a part of the actual filtrate compartment so that the volume of the displacement filtrate to be separated may be varied by moving the sealing member. Thus, the volume of the filtrate recycled may be controlled for example according to the running situation of the washer.

As may be understood from the above, the present invention provides a way of making the washing processes of the wood processing industry remarkably more economical and environmentally more friendly compared to the prior art methods and apparatus. It should, however, be born in mind that the embodiments described above are only a few preferred alternative examples of applying the present invention and they do not in any way intend to limit the scope of protection of the invention from the one described in the appended patent claims. Thus, although only examples of single-stage washers have been described the operation of multi-stage washers may be made more efficient by corresponding means.

We claim:

1. A method of displacement washing cellulose pulp using at least one washing stage, and a second stage, comprising a suction, press, and/or thickening stage, following the at least one washing stage, said method comprising the steps of:

(a) feeding cellulose pulp to the at least one washing stage to produce washed pulp;

(b) feeding the washed pulp to the second stage;

(c) withdrawing a first filtrate from the second stage;

(d) withdrawing a second filtrate from a washing stage of the at least one washing stage or the second stage; and (e) directing the first filtrate to the at least one washing stage and using the first filtrate as washing liquid in the at least one washing stage.

2. A method as recited in claim 1 wherein the washing stage comprises a last washing stage in a multi-stage fractionating washer, and wherein the second stage is in the fractionating washer; and wherein step (e) is practiced by directing the first filtrate to the last washing stage of the multi-stage fractionating washer.

3. A method as recited in claim 2 comprising the further step of adding clean wash liquor, from a source external to the at least one washing stage and the second stage, to the first filtrate in the practice of step (e).

4. A method as recited in claim 1 comprising the further step of adding clean wash liquor from another source to the first filtrate in the practice of step (e).

5. A method as recited in claim 1 wherein the at least one washing stage comprises at least first and second washing stages, prior to the second stage; and comprising the further step (f) of withdrawing a second filtrate, from the second washing stage; and wherein step (e) is practiced to direct the first filtrate, combined with at least a portion of the second filtrate, to the second washing stage.

6. A method as recited in claim 1 wherein the at least one washing stage and second stage comprise part of a fractionating washer; and wherein said method is practiced to withdraw at least two separate filtrates from each stage of the fractionating washer.

7. A method as recited in claim 6 comprising the further step of providing at least two different wash liquids to each washing stage.

8. A method as recited in claim 1 wherein the at least one washing stage comprises first and second zones, the second zone closer to the second stage than the first zone; and wherein step (e) is practiced to direct the first filtrate to the first zone of the at least one washing stage to serve as wash liquid therein.

9. A method as recited in claim 8 comprising the further step of using a wash liquid, distinct from the first filtrate, in the second zone.

10. A method as recited in claim 8 comprising the further step of adding clean wash liquor, from a source external to the at least one washing stage and the second stage, to the first filtrate in the practice of step (e).

11. A method as recited in claim 1 further comprising at least one dilution stage, at least one displacement stage, and at least one thickening stage; and wherein said method is practiced by feeding the pulp, in order, to the at least one dilution stage, the at least one displacement stage, and the at least one thickening stage.

12. A method as recited in claim 11 wherein the at least one washing stage comprises a plurality of washing stages, including a last washing stage having a beginning; and comprising the further step of withdrawing filtrate from the at least one thickening stage, and using it as wash liquid in the beginning of the last washing stage.

13. A method as recited in claim 1 further comprising at least one dilution stage, at least one first thickening stage, at least one displacement stage, and at least one second thickening stage; and wherein said method is practiced by feeding the pulp, in order, to the at least one dilution stage, the at least one first thickening stage, the at least one displacement stage, and the at least one second thickening stage.

14. A method as recited in claim 13 wherein the at least one washing stage comprises a plurality of washing stages, including a last washing stage having a beginning; and comprising the further step of withdrawing filtrate from the at least one second thickening stage, and using it as wash liquid in the beginning of the last washing stage.

15. A method as recited in claim 1 wherein the at least one washing stage comprises first and second washing stages, and wherein the second stage comprises a second thickening stage, and further comprising a dilution stage and a first thickening stage; and wherein said method comprises the steps of feeding the cellulose pulp to the dilution stage, the first thickening stage, the two washing stages, and then the second thickening stage.

16. A method as recited in claim 15 comprising the further steps of withdrawing a filtrate from one of the first and second washing stages, and using that filtrate as dilution liquid in the dilution stage.

17. A method as recited in claim 1 further comprising a dilution stage; and comprising the further step of withdrawing filtrate from at least one washing stage, and using that filtrate as dilution liquid in the dilution stage.

18. A method as recited in claim 1 wherein a washing stage comprises at least first and second zones, the second zone closer to the second stage; and comprising the further steps of withdrawing a filtrate from the second zone and using it as washing liquid in the first zone.

19. A method as recited in claim 1 wherein the at least one washing stage comprises first and second zones, the second zone closer to the second stage than the first zone; and wherein step (e) is practiced to direct the first filtrate, combined with at least a portion of the second filtrate, to the first zone of the at least one washing stage to serve as wash liquid therein.

* * * * *